United States Patent [19]

Sparks et al.

[11] 4,069,727

[45] Jan. 24, 1978

[54] SEPARATION OF LABEL TAPE INTO LABELS

[75] Inventors: Charles E. Sparks; J. G. Templeton; Melvin E. Larson, all of Grand Rapids, Mich.

[73] Assignee: Rospatch Corporation, Grand Rapids, Mich.

[21] Appl. No.: 761,436

[22] Filed: Jan. 21, 1977

Related U.S. Application Data

[63] Continuation of Ser. No. 527,876, Nov. 27, 1974, abandoned, which is a continuation-in-part of Ser. No. 436,175, Jan. 24, 1974, abandoned.

[51] Int. Cl.[2] ..... B26D 7/10; D03D 47/50

[52] U.S. Cl. ..... 83/16; 83/171; 156/88; 156/251; 156/282

[58] Field of Search ..... 156/88, 251, 282, 270, 156/498, 515; 83/15, 16, 170, 171

[56] References Cited

U.S. PATENT DOCUMENTS

| | | | |
|---|---|---|---|
| 3,284,269 | 11/1966 | Grevich | 156/515 |
| 3,483,778 | 12/1969 | Forthmann, Jr. | 83/16 |
| 3,531,359 | 9/1970 | Jones et al. | 156/515 |
| 3,536,567 | 10/1970 | Harrison | 156/498 |
| 3,536,568 | 10/1970 | Rothstein | 156/515 |
| 3,575,763 | 4/1971 | Ramsey | 156/515 X |
| 3,593,000 | 7/1971 | Forma | 156/575 X |
| 3,607,573 | 9/1971 | Michaelides et al. | 156/515 X |
| 3,871,933 | 3/1975 | De Brabander | 156/88 |

*Primary Examiner*—William A. Powell
*Assistant Examiner*—M. G. Wityshyn
*Attorney, Agent, or Firm*—Price, Heneveld, Huizenga & Cooper

[57] ABSTRACT

The separation of label tape formed of oriented thermoplastic polymer fibers into individual labels having wash-durable ends, by progressively melting the fibers, in a transverse zone of the tape, beginning at one face of the tape, while also progressively forcing the molten polymer, in a direction diagonally away from this zone and toward the opposite face of the tape, into the interstices between the unmolten fibers and with a portion of the polymer forced along said opposite face, using a heated beveled blade, having a blunt leading edge and chilling the molten polymer at said opposite face with a cold platen opposite the blade, to form a polymer anchor at said opposite face, and anchor the fibers in the polymer which serves as a matrix.

1 Claim, 20 Drawing Figures

HOT BLADE SIDE

FIG. 6.B.

SEPARATION OF LABEL TAPE INTO LABELS

CROSS REFERENCE TO RELATED APPLICATION

This is a continuation of copending application Ser. No. 527,876 entitled SEPARATION OF LABEL TAPE INTO LABELS, filed Nov. 27, 1974, now abandoned which in turn was a continuation-in-part application of Ser. No. 436,175, filed Jan. 24, 1974, now abandoned.

BACKGROUND OF THE INVENTION

This invention relates to labels for application to clothing, linens, safety belts and other like goods which are subjected to repeat cleaning and/or rough usage, and more particularly to the formation of individual washdurable labels of thermoplastic polymer fibers from a tape.

The attachment of labels to cloth goods such as clothing, linens, and other similar goods is a common practice to set forth information such as trademarks and tradenames, material identification and characteristics, care instructions, sizes and so forth. For many years, these labels were of cotton, rayon and other natural fibers. Such individual labels were usually cut from a long tape of label stock, either by the label manufacturer or the clothing manufacturer, and attached to the goods. Frequently, the cutting was performed with pinking or straight shear blades, and/or folded in various fashions and/or impregnated or coated with a binder to inhibit or limit unraveling at the ends.

In recent years, labeling requirements and other factors have necessitated use of labels made of thermoplastic fibers. Moreover, legal requirements have necessitated the use of larger and more labels as in clothing or on linens, for proper consumer protection, as well as labels that have high wash durability to remain intact and legible after many washes and much usage. Label stock formed of thermoplastic polymer fibers, either woven or nonwoven, have good general durability. But, the smooth and slippery characteristics of the fibers causing them to readily slide apart promote unraveling and concomitant disheveling of such labels at the cut ends. This has been a significant problem as is known in the trade.

In other arts where thermoplastic materials are employed, techniques such as hot wire cutting or hot blade cutting have been used. For example, film stock as for shrink wrapping or bag making has been cut with a simple hot blade arrangement. And cords or other heavy duty items like auto safety belt stock which are relatively stiff have been cut satisfactorily, although at low rates of production with a hot wire. Neither of these as known was really satisfactory for separation of thin fibrous label stock, however. This label stock varies in thickness between only about 0.004 and 0.015 of an inch, and presents very different problems from these. A hot wire is not effective on the thin flexible label type. Heated blades have been used to some extent, to sever this thin fibrous label stock, since they do form a fused smear of polymer over the ends of the severed fibers to hold them together. Unfortunately, it has been found that the holding action is not very resistant to rough usage or repeated washing or cleaning of the label with a garment. The polymer smear breaks loose from the label, allowing the fiber ends to unravel.

The present invention was discovered quite by accident, during pursuit of the development in copending application Ser. No. 436,175 filed Jan. 24, 1974. Specifically, in use of the apparatus in said application to sever label stock, it was conceived to use concentrated cooling of the platen, directly opposite the hot knife, to a temperature below that of the melting or fusion temperature of the polymer, to hopefully prevent sticking and fouling of the molten polymer on the cooled platen. The concentrated cooling accomplished this, and moreover also prevented the polymer on the label ends from sticking to other labels. So a substantial number of labels were severed with the apparatus. The heated knife not only severed the fibrous tape, but also held the fibers together by the melted polymer. created. Some time later, it was noticed with disappointment that there still was a tendency for some unraveling of the labels so formed. Further examination and evaluation showed that this tendency was primarily on one end of the individual label and not nearly so often on the other end. The present invention relates to the discovery of the problem and the solution to such problem of unraveling of thermoplastic fibers of thin labels formed from a label tape.

SUMMARY OF THE INVENTION

A method and an apparatus for separating a label tape of oriented thermoplastic polymer fibers into individual labels that are durable against unraveling after rough usage and repeated cleaning, rendering them particularly advantageous on clothing, linens, safety belts, and other uses where such is encountered. The label tape is separated into individual labels at intervals between a platen having concentrated cooling opposite a heated blade, the heated blade having a substantially flat leading edge and a pair of sloped surfaces extending therefrom at an acute angle within the range of about 15° to about 60° from the direction of blade reciprocation, the blade causing localized transverse zones of the label tape polymer fibers to be progressively melted from one face of the tape to the opposite face of the tape while the formed melted polymer is forced in a direction both longitudinally of the tape and toward the cooled anvil, into the interstices between the unmolten oriented fibers clear through to the opposite tape face where a portion of the polymer extending along this face is chilled and resolidified as an anchor for the subsequently solidified polymer in the interstices that forms a matrix for the fibers. Both ends of the labels so formed have the fibers firmly bonded against unraveling, as proven by extensive testing.

BRIEF DESCRIPTION OF THE DRAWINGS

FIG. 6B is an elevational view of the assembly in FIG. 6A, at the subsequent stage when the elements are separated;

DESCRIPTION OF THE PREFERRED EMBODIMENT

The present development is the result of a discovery occurring during efforts to employ hot knife cutting of thin thermoplastic fibrous label tape material. The thin fibrous label stock, in the thickness range of about 0.004 to about 0.015 of an inch, is not amenable to hot wire cutting. Hot blade cutting caused sticking and cumulative fouling of polymer at the platen supporting the label stock, and thus was not acceptable. It also caused the label ends to stick to other labels when stacked or otherwise placed in contact. The combination of a hot knife and a cooled platen as set forth in copending application Ser. No. 436,175, appeared to present the practical way to separate a fibrous label tape into individual labels, but was subsequently found to be less than satisfactory because the individual labels were not remaining durable against unraveling, particularly one end as noted above.

Microscopic examination of these last noted labels showed that one end had fused polymer in the form of a smeared surface extending across the ends of the fibers, while the other end tended to have polymer penetrating into the interstices between the fibers and joined into anchored relation with a polymer anchor extending along and bonded to one face of the label adjacent this label end. Further experimentation showed that this first type of end was the one which tended to fray or become unraveled, while the opposite end was durable even when subjected to extreme repeated washing and wear conditions. Further experimentation and subsequent microscopic examination resulted in the finding that at the smeared polymer end, the smeared polymer tended to become detached, allowing the fibers to unravel. Further, it was noted that this smeared end (A) was the one created at the flat side K′ of the sharp knife K generally normal to the label tape T and platen 20 (left side of knife in FIG. 7). And, the stable end (B) was the other one which had the polymer penetration into the fiber interstices, forming a matrix (C) which was bonded to the polymer anchor (D) along the one label face. Moreover, experimentation showed that this penetration was caused by the sloped knife face K″ in cooperation with the cooled platen, the cooled platen causing the formation of the polymer anchor along the label face, and the penetrating polymer ultimately joining the anchoring polymer at the final stages of the progressive melting of the knife through the fibers. The fibers which had their interstices penetrated were not only not molten but also were found to have retained their molecular orientation and thus were still individually strong. This strength factor contributed to the durability of this label end. As is known, this molecular orientation is imparted to the individual fibers by stretching them when originally formed as by common spinning techniques, and can typically be detected by X-ray diffraction and/or other known techniques.

Figure 1A:
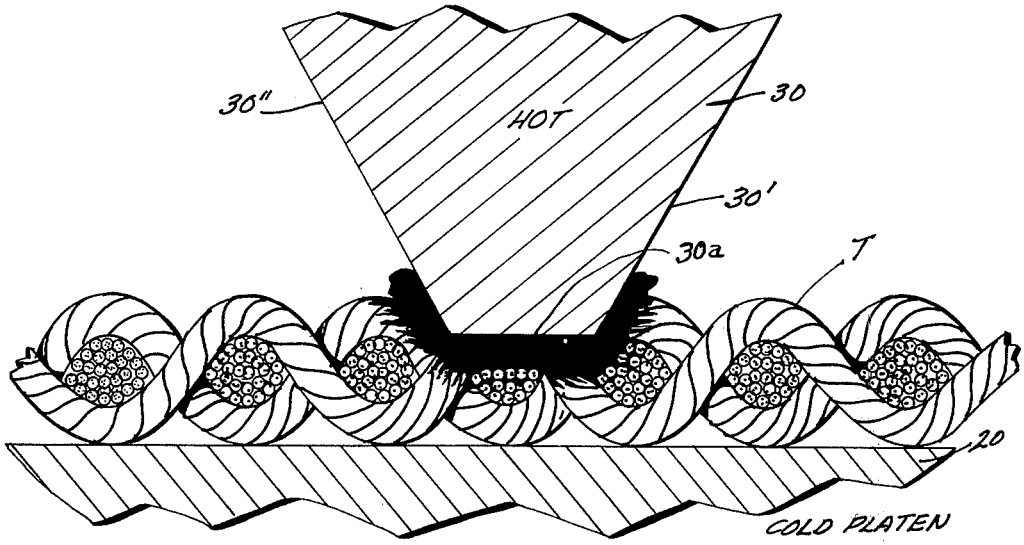
FIG. 1A is a greatly enlarged, fragmentary, sectional elevational view showing an early stage of the double bevel hot blade melting into a thermoplastic fibrous label tape on a cold platen, as seen under magnification.
Figure 1B:
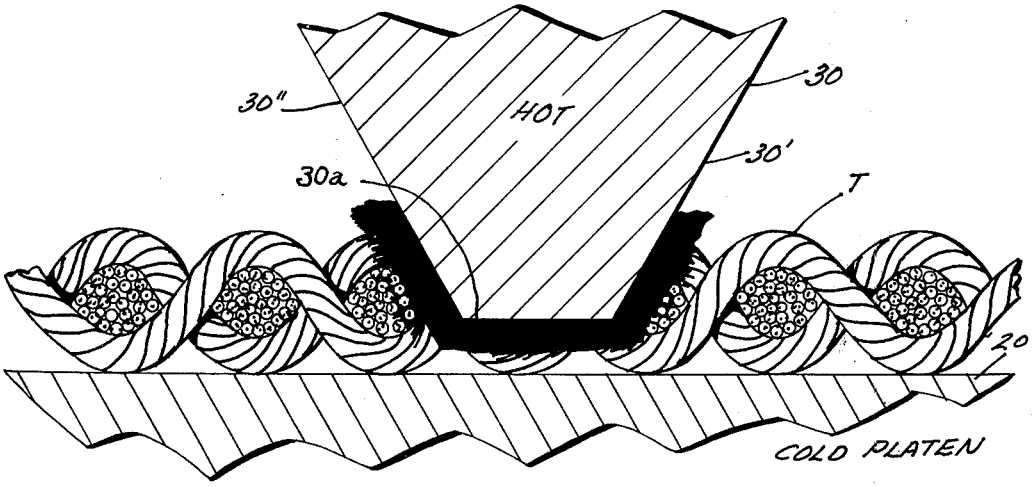
FIG. 1B is the sectional view in 1A, at a subsequent stage.
Figure 1C:
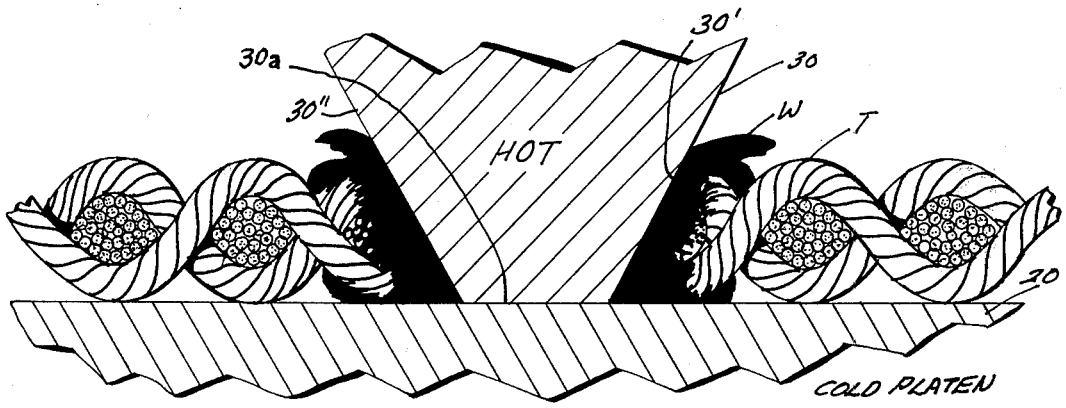
FIG. 1C is the sectional view in 1A and 1B at the final stages.
Figure 1D:
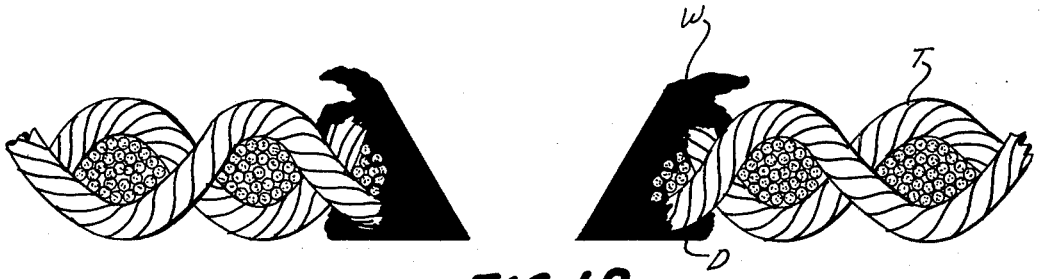
FIG. 1D is a sectional view of the separated label ends in FIG. 1C.
Figure 2:
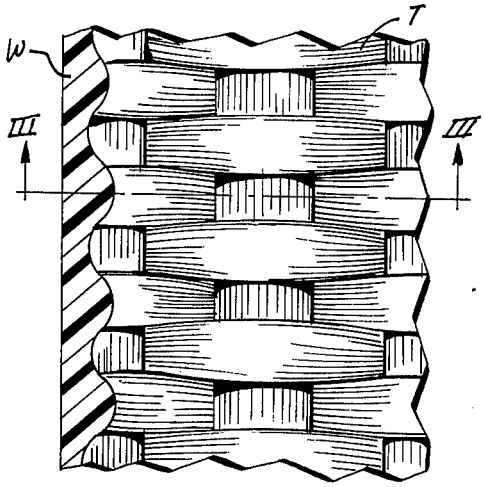
FIG. 2 is a top plan fragmentary enlarged view of the label stock to the right of the blade in FIG. 3, after completion of the operation, as seen under magnification.
Figure 3:
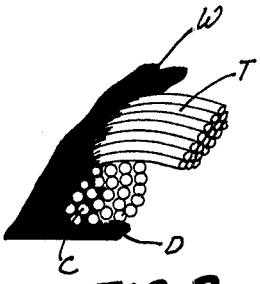
FIG. 3 is a sectional, somewhat perspective, fragmentary, greatly enlarged view of the left end of the label portion in FIG. 2, taken on plane III-III, as seen under the microscope.
Figure 7:
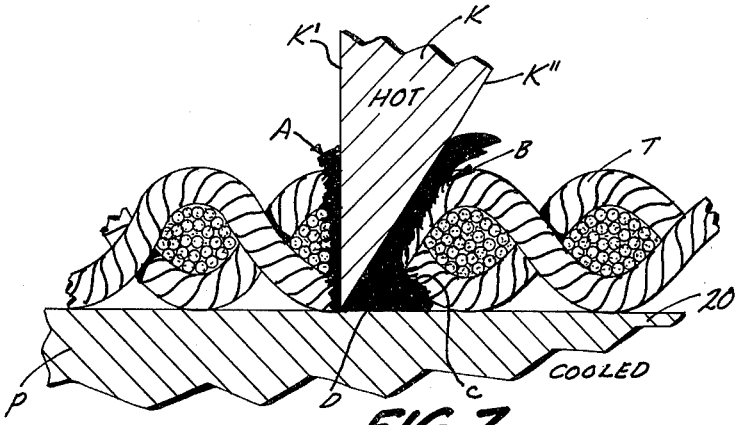
FIG. 7 is a diagrammatic view of a knife and platen, showing the shape of the knife used in the combination of copending application S.N. 436,175 identified herein.
Figure 5:
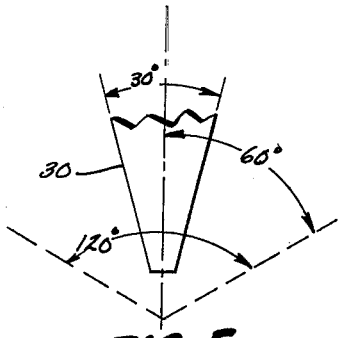
FIG. 5 is a diagrammatic view of the hot blade angle range for this invention.
Figure 4:
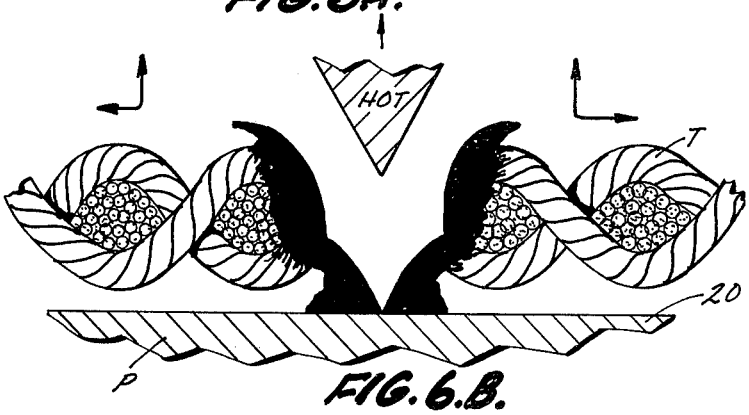
FIG. 4 is a bottom fragmentary enlarged view of the label stock in FIG. 2.
Figure 4:
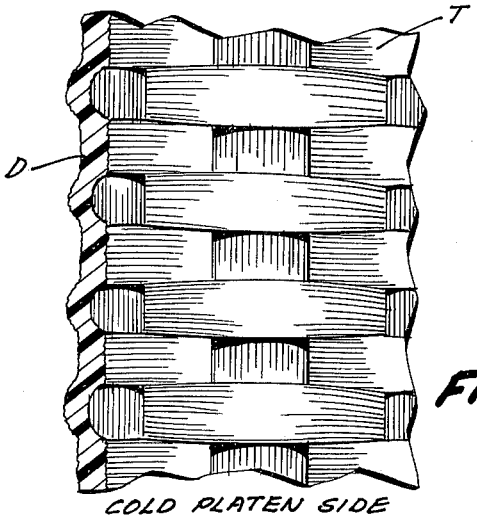

Based on this series of findings, the hot knife K depicted in FIG. 7 was substituted by a double bevel hot blade 30 of the type depicted in FIG. 1A-1C. This blade was provided with a blunt leading edge 30*a* which is substantially flat, of a width at least about equal to the thickness of the label tape being operated upon, i.e., about 0.004 to 0.015 inch, and up to about one and one half the label tape thickness. This blunt edge effects the melting of a sufficient volume of polymer to assure its being forced through the tape and to assure formation of an effective anchor at the platen side face of the labels. The result was labels having durability. Roughness and washing testing showed both ends of each label to have high durability. Both ends were shown by microscopic examination to have a polymer matrix through the interstices of the adjacent, strong, unmelted fibers, and which polymer matrix was bonded to the polymer anchors which formed along the underside face of the label ends. The blade shape was found to be highly effective between angles of the sloped faces to the plane normal to the platen (i.e., in the direction of the blade reciprocation) of about 15° to about 60°, i.e., having an included angle in the range of about 30° to about 120° (FIG. 5). An angles much less than this, the tendency was to produce a smearing type fusion having insufficient durability, although the presence of the flat or blunt leading edge has a significant influence. That is, the blunt leading edge enables a smaller angle to be employed, at least on one side without loss of the effective durability, although it is preferred to have the combination of the substantially flat leading and substantial angles of slope on both sides of the blade. The length of the sloped portion of the beveled sides 30′ and 30″ of blade 30 need only be sufficient to be greater than the thickness of the label tape T.

Figure 6A:
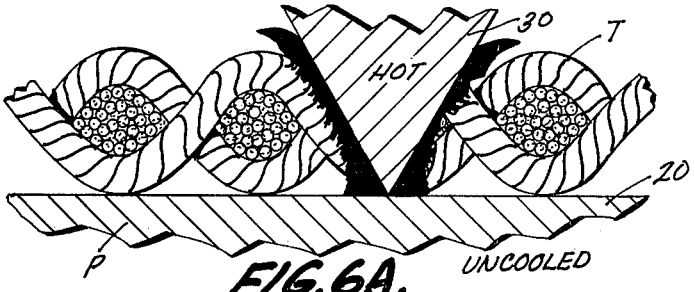
FIG. 6A is a greatly enlarged, fragmentary sectional, elevational view showing the use of a hot sharp blade in combination with an uncooled platen.

Subsequently, an uncooled platen P (FIG. 6A) was tried in place of the cooled platen 20, (FIG. 6B), but this was not satisfactory because even though some penetration occurred, the polymer anchor D was not formed at the platen surface for this penetrated matrix. The molten polymer stuck to the platen and pulled away from the fibers (FIG. 6B), such that the label ends did not exhibit the necessary wash durability. Rather, the polymer at the platen side formed a saw tooth configuration projecting down away from the label face after the blade and platen were withdrawn, and was not effective.

Thousands of labels were formed from a thin thermoplastic fiber label tape with this progressive melting by the tapered hot blade having a blunt leading edge in opposition to a platen having concentrated cooling opposite the hot blade, resulting in the fiber interstice penetration and the formation of the polymer anchor on the tape face at the cooled platen surface. It was determined that the solution was found to the longstanding problem of wash durability of labels formed of thermoplastic fibers. The solution was based upon discovery of the true nature of the problem as well as the particular hot blade in combination with the platen cooled directly opposite the blade. Once this solution was found, its application to label manufacture was relatively easy. It can serve admirably to provide customers of clothing, linens, etc. with desired product quality.

Interestingly, the polymer at the label face on the hot blade side, as opposed to the label face on the cold platen side, does not form a polymer anchor but rather a splash wave W of polymer (FIG. 1C, 1D, 2, and 3) which does not seem to contribute significantly to the durability.

The apparatus for practicing this is disclosed basically in FIGS. 8–14, and is described in detail below. This apparatus can be combined with a label tape printing machine, as set forth relative to FIGS. 15–16, or can be combined with a label cutting and stacking machine, which may or may not include a label folding device.

Referring now to FIGS. 8–14, the apparatus 1 (FIGS. 8 and 9) includes a blade slide housing 10 having blade assembly 40 slidably mounted therein. Housing 10 is rigidly attached to support pads 11. Adjustable platen 20 is mounted on housing 10, above and in opposition to heated blade 30 of assembly 40. The position of these elements can be reversed as in FIG. 1A-C if desired, i.e., the platen above the blade. Feed table 50 (FIG. 10) is mounted under platen 20 and adjacent blade 30. Blade 30 is heated by an electrical heating cartridge 32 inserted in a tubular heat passage 31, (FIG. 10) in blade 30. The complete blade assembly 40, which is basically a double-slide assembly, is driven by cam 12, shown in FIGS. 8 and 13.

Cam 12 cooperates with cam follower 13 which is attached to slide 41. Spring platform 15 is also secured to slide 41. Compression coil springs 35 are retained between platform 15 and plate 17 which is secured to slide 42. Blade 30 is attached to slide 42. Slide 41 can be moved relative to slide 42 against the bias of the springs.

In an operating cycle, cam 12, through follower 13, shifts both slides 41 and 42 and blade 30 (attached to blade slide 42), upward until the leading edge of blade 30 contacts surface 22 of platen 20. At this time, blade 30 and slide 42 stop, while upward motion of slide 41 continues, to compress springs 33 which firmly press blade 30 against the surface 22 of the platen, or specifically against the label tape first, and then ultimately against the platen. As cam 12 completes the cycle, internal compression springs **13*a*, housed in spring wells 13*b* of housing 10 (FIG. 14), return the double-slide assembly 40 to its initial position, completing the cycle, by pushing downward on rear section 15*a* of spring platform 15**.

Figure 12:
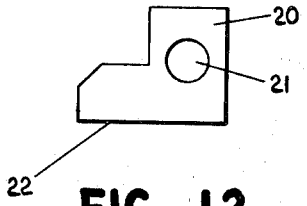
FIG. 12 is a side elevational view of the cooled platen.
Figure 13:
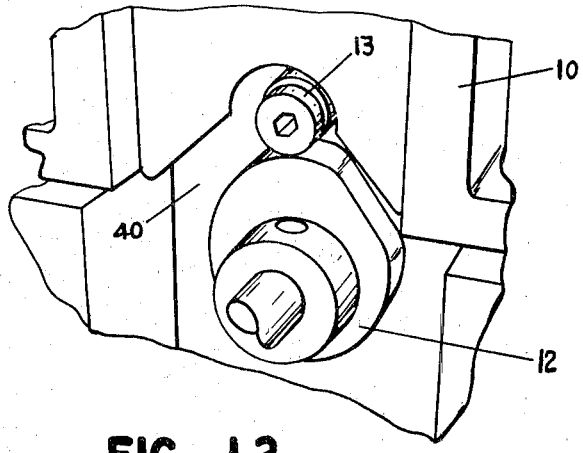
FIG. 13 is a rear, fragmentary, perspective view of the apparatus in FIG. 8.
Figure 11:
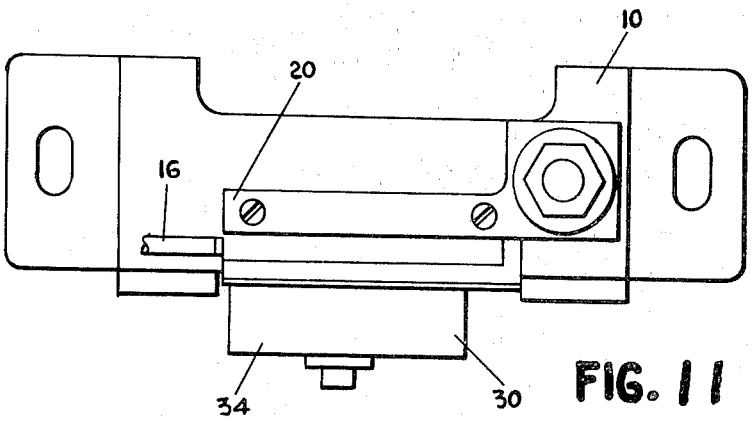
FIG. 11 is a plan view of the apparatus in FIG. 9.

A cooling fluid flowing through cooling passage 21 (FIG. 10), cools the platen directly opposite the heated blade. The cooling passage 21 may comprise one channel through platen 20 as shown in FIG. 12, or multiple channels as in FIGS. 8–10. In the embodiment shown in FIGS. 8–10, cooling passage 21 begins on the side wall of platen 20 and extends generally to the other structural side wall, wherein it returns back to the initial side wall. In platen 20 (FIG. 12), cooling passage 21 extends from one side of the platen 20 through the other side.

Figure 8:
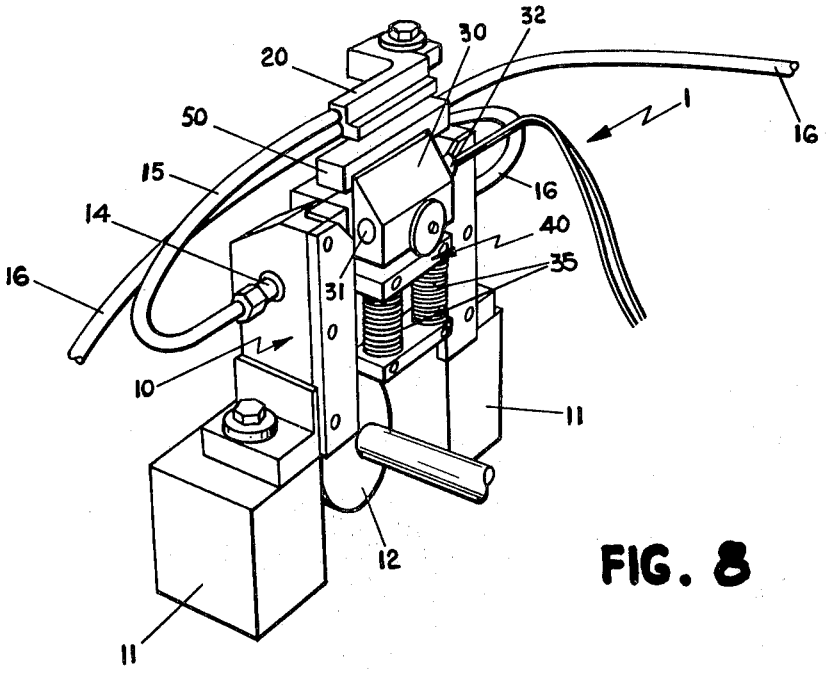
FIG. 8 is a perspective view of the apparatus herein.
Figure 9:
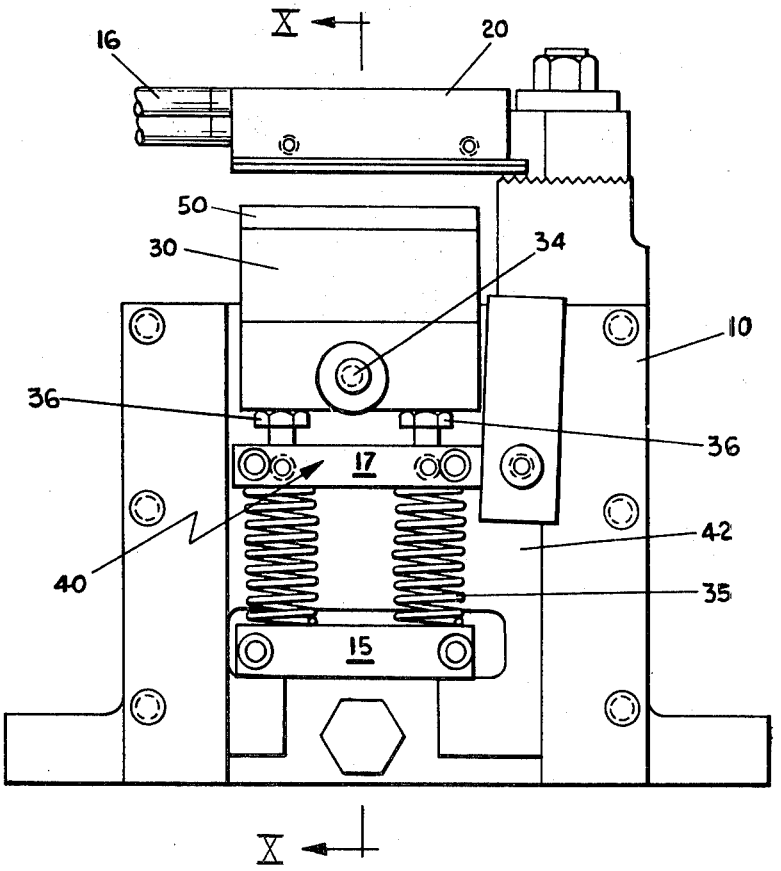
FIG. 9 is an elevational view of the apparatus in FIG. 8.
Figure 10:
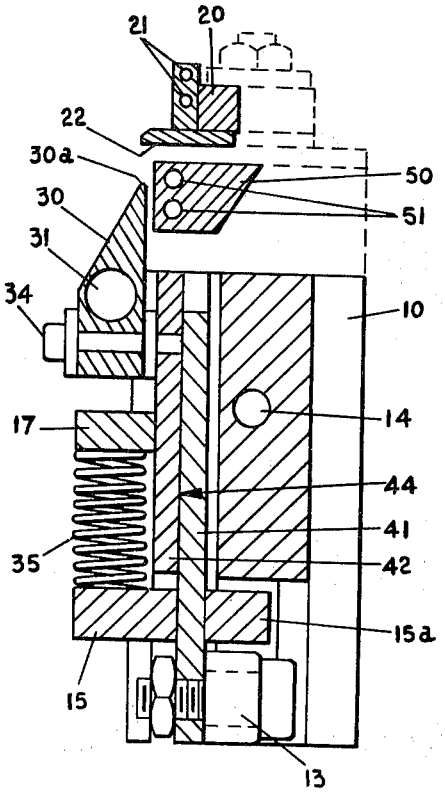
FIG. 10 is a sectional view taken on plane X-X of FIG. 9.
Figure 14:
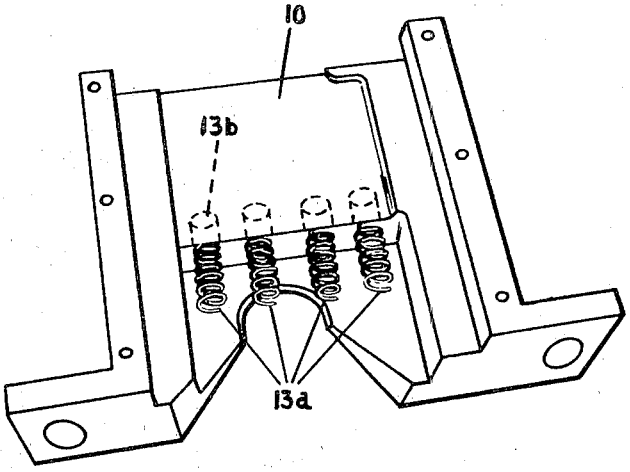
FIG. 14 is a front perspective view of the blade housing with the blade assembly removed.

In the apparatus of FIG. 8, housing 10 is cooled by flowing the cooling substance through passageway 14 (FIGS. 8 and 10).

Blade 30 is attached to blade slide 42 by bolt 34. The blade height, with respect to blade slide 42, is adjusted by leveling bolts 36 (shown in FIG. 9 only).

As shown in FIG. 10, platen 20 may be a composite of elements, one of such elements comprising means to form cooling passage 21. Or as shown in FIG. 12, platen 20 may be a unibody structure.

If the apparatus is employed as part of an automated apparatus for printing and separation of tapes into labels, (FIGS. 15 and 16), tape feed table 50 is mounted on a feeding apparatus 70 which feeds tape into and from tape printer assembly 61 into apparatus 1 which is essentially the same as shown in FIGS. 8–14. The tape feeding assembly 70 may be one of a number of conventional devices. As shown, it is a roll feeder. The tape printer assembly 61 may also be one of a number of suitable devices.

Figure 16:
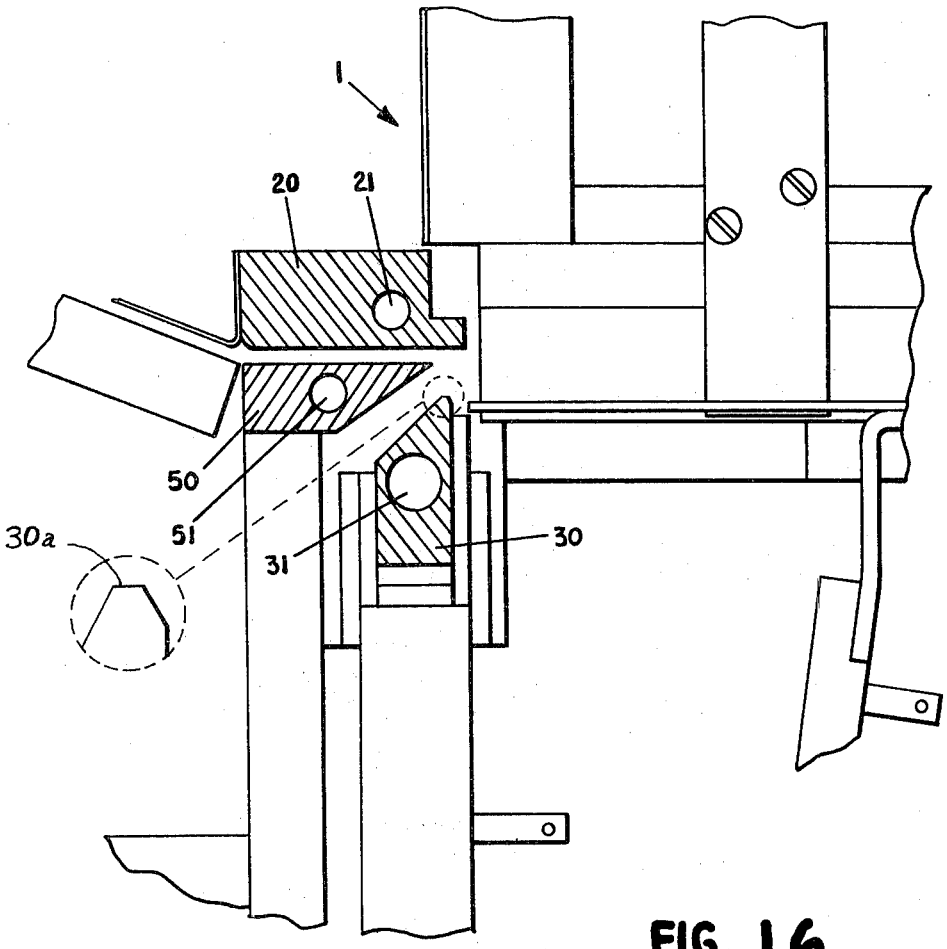
FIG. 16 is a fragmentary, enlarged, partially sectioned, elevational view of the apparatus in FIG. 15.

The feed table 50, as shown in FIGS. 8, 10, and 16 is a cooled surface over which the tape is fed to heated blade 30. The cooling of feed table 50 and platen 20 is achieved by flow of a cooling substance e.g. water through passageway 51 of table 50 and through passageway 21 of platen 20, using tubing 16 which interconnects the cooled elements and is attached to a cooling substance supply, e.g., faucet or recirculating pump, and at its other end to a discharge exit or drain.

The blade is heated to a temperature significantly greater than the fusion or melting temperature of the tape. This temperature can be readily set for the particular tape polymer, using the teachings set forth herein and observing the quality of the label ends. The temperature of the cooling elements is maintained substantially below the fusion or melting temperature of the tape.

Figure 15:
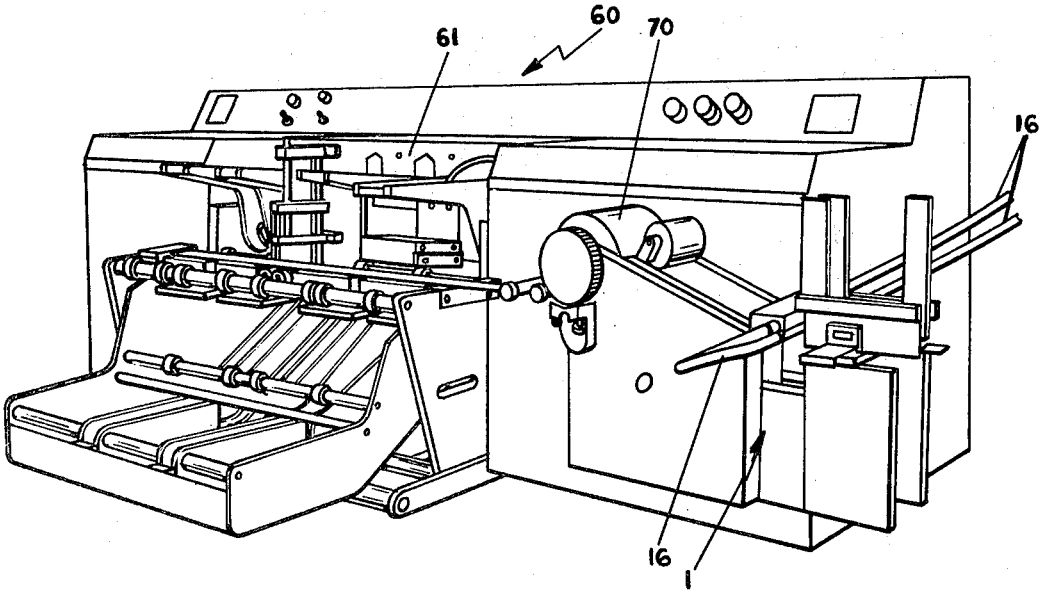
FIG. 15 is a front perspective view of an automated label tape printing and label separating apparatus in combination.

In the operation of automated apparatus 60, tape is fed, after printing at 61, into severing apparatus 1 along tape feed table 50 by feeder assembly 70 (FIG. 15). After a predetermined length of tape is fed between platen 20 and blade 30, cam 12 drives blade assembly 40 upward until blade edge **30*a* of blade 30 engages the label tape. Then, slide 41 continues to move, sliding on blade slide 42 along juncture 44, and pushes compression springs 35 upward, securely pressing hot blade edge 30*a* progressively through the tape and against surface 22. As cam 7 completes rotation of its cycle, internal compression springs 13, shown in FIG. 7, push slide assembly 40 downwardly and slip slide 41 and blade slide 42** return to their original position. Another predetermined length of tape is then fed into the apparatus and the cycle is repeated.

This invention is useful for thermoplastic polymeric tapes of woven or nonwover fibrous material, such polymers being typically a polyester, nylon, acetate, or other known thermoplastic materials used for labels.

It will be understood that various changes in the illustrative details and arrangements of parts used herein to illustrate the concept may be made by those skilled in the art, the scope of the invention being defined in the appended claims.

The embodiments of the invention in which an exclusive property or privilege is claimed are defined as follows.

1. A method of separating a label tape of a thickness in the range of about 0.004 to 0.015 of an inch and formed of oriented thermoplastic polymer fibers, into individual labels having wash-durable ends, comprising the steps of:

forcing a double beveled hot blade having a substantially flat leading edge against one face of the label tape while continuously maintaining the temperature of the blade edge above the melting temperature of the polymer fibers to melt a localized transverse zone of the label tape polymer fibers progressively from one face of the tape to the opposite face while progressively forcing the molten polymer in a direction both longitudinally of the tape and toward said opposite face into the interstices between the unmolten oriented fibers through to said opposite face, and along said opposite face, and restraining the opposite face of the label tape with a cold platen, said cold platen having a surface supporting said opposite face of said label tape, with its said surface being located directly opposite said flat leading edge of said hot blade towards which said hot blade is forced, while continuously maintaining the temperature of the platen substantially below the melting temperature of the polymer fibers with cooling means to rapidly chill and resolidify said molten polymer along said opposite face into an anchor bonded to said polymer in the interstices, to thereby create wash-durable ends on the individual label; followed by removing said blade from contact with said label tape while said blade is still hot and said platen is still cold.

* * * * *

UNITED STATES PATENT AND TRADEMARK OFFICE

CERTIFICATE OF CORRECTION

PATENT NO. : 4,069,727

DATED : January 24, 1978

INVENTOR(S) : Sparks et al.

It is certified that error appears in the above-identified patent and that said Letters Patent are hereby corrected as shown below:

Column 1; line 18:

"washdurable" should be - - wash durable - -

Column 1; line 60:

"type" should be - - tape - -

Column 4; line 48:

"An" should be - - At - -

Column 4; line 61:

Delete "(Fig. 6B)"

Signed and Sealed this

*Twenty-sixth* Day of *September 1978*

[SEAL]

*Attest:*

RUTH C. MASON
*Attesting Officer*

DONALD W. BANNER
*Commissioner of Patents and Trademarks*